US005145067A

United States Patent [19]

Carver

[11] Patent Number: 5,145,067

[45] Date of Patent: Sep. 8, 1992

[54] CARTON WITH SIDE MOUNTED LOCKING TABS

[75] Inventor: Robert G. Carver, Ashland, Ohio

[73] Assignee: Coburn, Inc., Ashland, Ohio

[21] Appl. No.: 808,005

[22] Filed: Dec. 16, 1991

[51] Int. Cl.[5] ..... B65D 71/46

[52] U.S. Cl. ..... 206/426; 206/434; 229/40

[58] Field of Search ..... 206/140, 427, 429, 434, 206/426; 229/40

[56] References Cited

U.S. PATENT DOCUMENTS

| | | | |
|---|---|---|---|
| 2,798,655 | 7/1957 | Buttery et al. | 206/434 |
| 2,817,473 | 12/1957 | Foster | 229/40 |
| 2,888,135 | 5/1959 | Guyer | 206/434 |
| 3,083,825 | 4/1963 | Larsen | 206/434 |
| 3,854,580 | 12/1974 | Hennessey | 206/426 |
| 3,896,927 | 7/1975 | Dutcher | 206/429 |
| 4,164,286 | 8/1979 | Sutherland | 206/434 |
| 4,627,536 | 12/1986 | Pugh | 206/426 |
| 4,629,069 | 12/1986 | Pugh | 206/426 |
| 4,640,417 | 2/1987 | Durand | 206/426 |
| 4,735,314 | 5/1988 | Kadleck | 206/426 |
| 4,798,291 | 1/1989 | Carver | 206/426 |
| 4,875,585 | 10/1989 | Kadleck | 206/426 |
| 4,890,738 | 1/1990 | Carver | 206/426 |

FOREIGN PATENT DOCUMENTS 1565350 4/1980 United Kingdom .

*Primary Examiner*—Jimmy G. Foster
*Attorney, Agent, or Firm*—Renner, Otto, Boisselle & Sklar

[57] ABSTRACT

A carton for glassware or like articles includes a conventional sleeve with a top, a bottom, sidewalls and a central dividing panel. Locking mechanisms are located on each end of the sidewalls. Each locking mechanism includes a connected series of panels hinged to a sidewall of the carton at two places. The locking panels have an initial position in which they are flat and out of the way to permit articles to be placed in the carton. To hold the articles inside the carton, the locking panels are shifted to form a wedge shape which partially blocks the open ends of the sleeve. A locking tab is folded into the interior of the wedge to hold it in place. Preferably the locking panels are three in number and extend from an edge of a sidewall of the carton.

10 Claims, 3 Drawing Sheets

CARTON WITH SIDE MOUNTED LOCKING TABS

FIELD OF THE INVENTION

The present invention relates generally to the cardboard carton art and particularly to sleeve type cartons for glassware or the like.

BACKGROUND OF THE INVENTION

Glassware is often marketed in sleeve type carriers which surround the top, bottom and two sides of a group of glasses, usually four in number. Various methods have been used to keep the glasses inside such a sleeve. Included among these are various tabs which lock onto or extend from a central web or reinforcing panel which vertically bisects the carton. Typical of these cartons are those shown in the following U.S. patents: U.S. Pat. Nos. 4,890,738; 4,875,585; 4,798,291; 4,735,314; 4,640,417; 3,854,580; and 2,817,473. U.K. Patent 1,565,350 also shows a carton for glassware. In U.K.'350, retaining tabs fold up out of the bottom of the carton to hold the base of the glass in place.

The efficiency and ease with which sleeve type cartons can be packed with their intended merchandise is an important factor in their marketability. Cartons that are slow or difficult to be loaded are less desirable than ones that are easy to load with comfortable hand motions. Once glassware is in a carton, it should be retained securely in a manner which resists accidental removal of the glassware from the carton. Whatever latching mechanism is used must not interfere unduly with the consumer's ability to view the glassware in the carton so as to promote sales of the glassware. Of course, many of the same considerations apply even where the articles to be placed in the carton are not glasses.

SUMMARY OF THE INVENTION

The present invention provides a carton for glassware or the like with a unique and easy to use lock mechanism which holds the contents securely in the carton while still allowing attractive display of the merchandise. The carton is of the conventional sleeve type, having top and bottom panels, left and right side panels, and a central reinforcing panel parallel to the sides which extends between the top and bottom panels and vertically bisects the space inside the carton. The front and back ends of the carton are open. The carton accommodates four glasses, two on each side of the central panel. Each side panel includes two lock mechanisms, one at the front and one at the back, which serve to retain the glassware inside the carton.

Each lock mechanism is formed of two components. The first is a flap which comprises three hinged panels connected to each other and the carton side panel along fold lines. Initially the flap is folded so that its panels lie flat against the carton side panel. This permits the carton to be loaded. Then the hinged panels of the flap are flexed along the fold lines to a second position in which they form a wedge shape on the inside of the side panel to keep the glassware inside the carton.

The second component of the lock mechanism is a locking tab that holds the flap panels in the wedge shape. The locking tab is pressed inward from the side panel and locks inside the wedge shape to hold the hinged panels in their wedge position. The entire process of shifting the hinged panels to the wedge shape and latching them in that position can be easily accomplished using only a thumb and forefinger.

BRIEF DESCRIPTION OF THE DRAWINGS

Preferred embodiments of the present invention are described in the following specification which, when taken together with the accompanying drawings, will enable those skilled in the art to make and use it.

In the annexed drawings.

DESCRIPTION OF PREFERRED EMBODIMENTS

Figure 1:
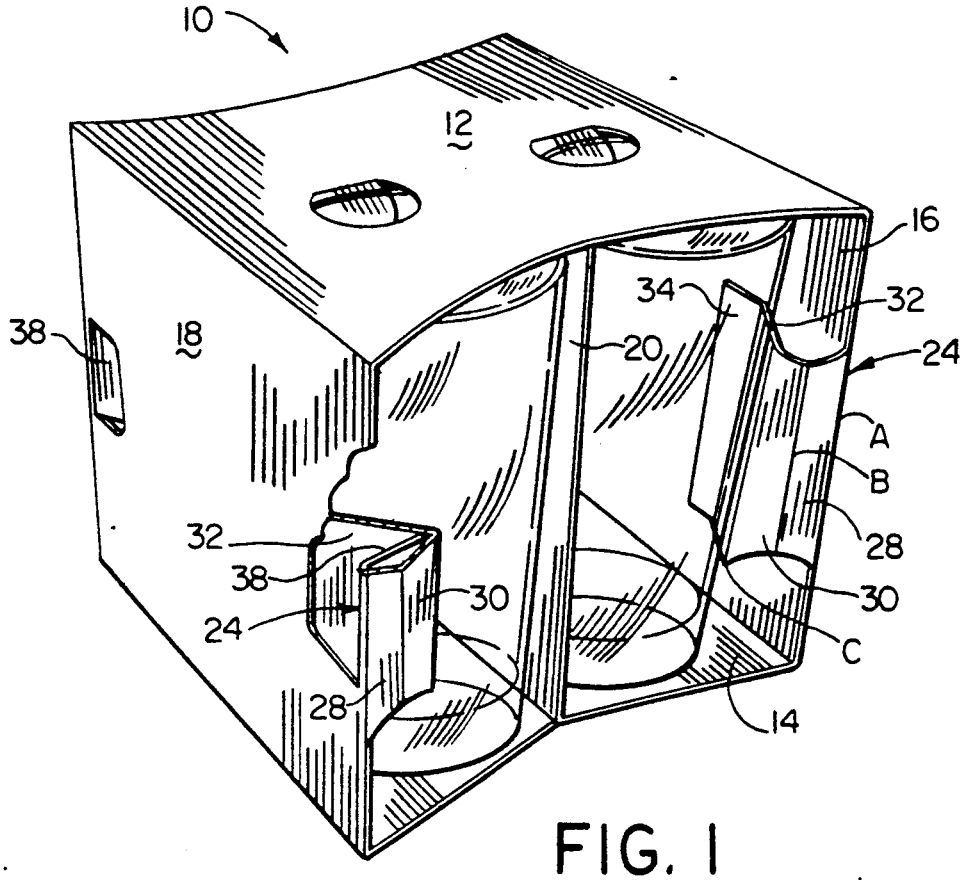
FIG. 1 is a perspective illustration of a carton constructed in accordance with the present invention with tumblers inside the carton held in place by lock mechanisms.

The carton 10 shown in FIG. 1 is formed as a sleeve from a single sheet of cardboard or other flexible material. The carton includes a top panel 12, a bottom panel 14, a right side panel 16 and a left side panel 18. A central dividing panel 20 extends between the bottom panel 14 and top panel 12 and vertically bisects the interior of the carton 10. The carton 10 holds four tumblers, two of which are shown in FIG. 1, and two of which are located behind those shown.

The present invention, although shown used in connection with glassware, is not so limited. It could easily be used in connection with cans, or any other article which extends from the bottom panel 14 to the top panel 12 and which has sides which the lock mechanism of the present invention can engage. Moreover, it is not necessary that the carton 10 contain only four articles. The carton 10 could be elongated to hold more articles and still utilize the features of the present invention.

The carton 10 may be contoured to conform to the shape of the articles to be placed in it. The tumblers shown in FIG. 1 have straight sidewalls which are nearly vertical when the tumbler is on a horizontal surface. For such glassware, the side panels 16 and 18 are planar and essentially vertical, and so the sleeve has a rectangular cross section. For other glassware with curved sides such as some stemware, the side panels 16 and 18 may be bowed or arched outward slightly around the midsection of the carton so that the sleeve follows the shape of the glass or other article to be carried in the carton.

The carton 10 includes four identical lock mechanisms 24 (only two of which are shown in FIG. 1) which hold the glassware in the carton. Only one of the lock mechanisms will be discussed in detail, but it will be understood that the description applies equally to the others, and the same numerals have been used in the drawings to designate similar parts on each lock mechanism.

The lock mechanism 24 is formed of two components. The first is a flap 26 extending from the side panel, e.g., 16. See FIG. 8. The flap 26 is divided by fold lines A, B, C and D (FIGS. 1, 4 and 8) into three successive panels, panel 28 (the proximal panel), panel 30 (the intermediate or adjacent panel), and panel 32 (the distal panel). A glue flap 34 is at the remote end of flap 26 and hinged to panel 32. The flap 26 is initially folded only along fold line B so that panels 30 and 28 lie on top of each other and panel 32 and the glue flap 26 lie against the inside surface of side panel 16. The glue tab 34 is glued to the inside surface of the sidewall 16.

The lock mechanism 24 also includes a locking tab 38 (see FIGS. 5–8) to hold the lock mechanism 24 in its article retaining position. This locking tab 38 is defined by a U-shaped cut line in the side panel 16 which begins and ends at fold line A. In the initial position shown in FIGS. 2–4, the free edge 39 of the locking tab 38 is directly against panel 32 of the flap 26.

Figure 2:
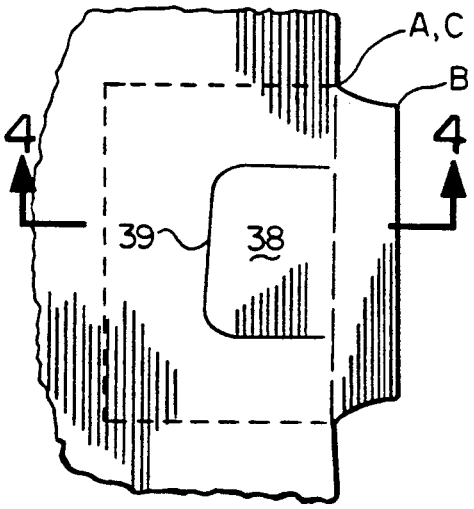
FIG. 2 is a view of the outside of a portion of the carton of FIG. 1 showing a lock mechanism before the tumblers are placed in the carton.
Figure 3:
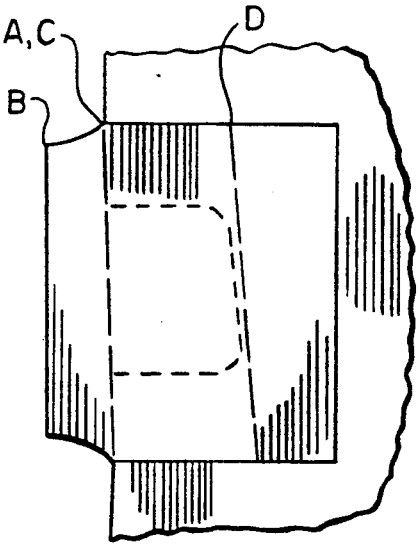
FIG. 3 is a view similar to FIG. 2 but looking at the lock mechanism from inside the carton.
Figure 4:
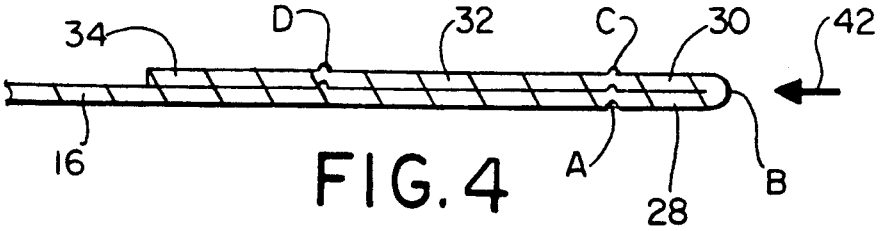
FIG. 4 is a view looking in the direction of arrows 4—4 of FIG. 2.

When carton 10 is loaded with glassware or other articles, locking mechanisms 24 are all as shown in FIGS. 2–4. Then the operator presses on fold line B at the apex of the flap 26 in the direction of arrow 42. This causes panels 28 and 30 to move away from each other and panel 32 to lift off the inside surface of the side panel 16. The glue tab 34 remains in place so fold line D is relatively fixed. As panel 32 moves inward, panels 32 and 34 pivot with respect to each other about a crease which defines fold line D. Pressure in the direction of arrow 42 continues until panels 28 and 30 are almost coplanar. At the same time the operator turns the locking tab 38 along fold line A by pressing in the direction of arrow 43.

Figure 5:
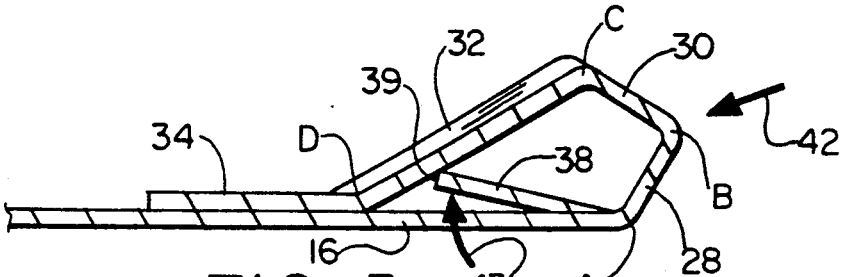
FIGS. 5–7 are views similar to FIG. 4 but showing the lock mechanism in successive stages of movement from the position shown in FIG. 4 to a fully locked position as shown in FIGS. 1 and 7.
Figure 6:
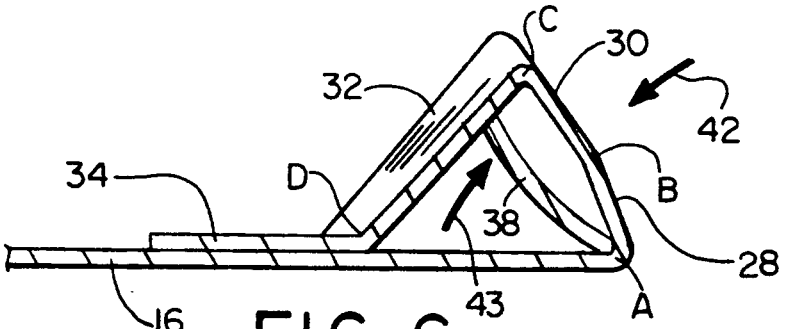
Figure 7:
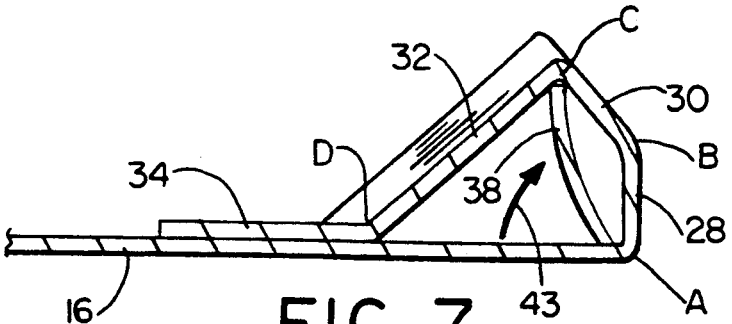

As the tab 38 moves counterclockwise (as shown in FIGS. 5–7), the free edge 39 of the locking tab rides along the inside surface of panel 32. This tends to stretch the two panels 28 and 30 toward a coplanar arrangement, and the locking tab 38 may even bow slightly as shown in FIGS. 6 and 7 as the locking tab moves.

Movement of the locking tab 38 passes through a top dead center position as illustrated in FIG. 6. There, the plane of the locking tab 38 is approximately perpendicular to the plane of panel 32, and at that point the panels 28 and 30 are as close to being in alignment, i.e., coplanar, as they will get. Further counterclockwise movement of the locking tab 38 brings it into the vertex formed at the fold line C between panels 32 and 30. This tends to release some of the bending of the tabs 38 and to allow panels 28 and 30 to move toward their initial position, thus releasing elastic energy that had been stored by the flexing and stretching of the cardboard which takes place as the tab 38 moves past the top dead center position of FIG. 6.

The resistance to bending of the joints along fold lines A, B, C and D caused by the inherent resilience of the cardboard material of which the carton is made causes the flap 26 to resist the movement described above. When the locking tab 38 is pushed past top dead center to the position shown in FIG. 7, the resilience of the material of which the carton 10 is manufactured tends to keep the locking tab in place. This locks the flap 26 with its panels 28, 30 and 32 forming a wedge shape which prevents the glassware from being removed from the carton 10 accidentally.

Thus the flap panels 28, 30 and 32, when taken together with the sidewall 16 act like a four bar linkage. Initially the linkage is free to pivot about its four axes, although the resilience of the cardboard tends to hold it with the links in a collapsed state as shown in FIG. 4. Once the locking mechanism is shifted to its article-retaining wedge shape, the locking tab 38 holds the panels in that shape because it acts to convert the four bar linkage into a truss.

Folds lines A, B, C and D are fabricated in a manner which eases proper folding of the lock mechanism 24. Fold line A is a conventional creased fold line. It is manufactured with a male and female die which slightly crush and displace some of the cardboard material to define a fold line. Fold line B is manufactured with a score line which extends approximately three-quarters of the thickness of the material and 90% of the length of the line B. The fold lines C and D are formed by alternating creases and through cuts. For example, fold line C is formed with four through cuts of equal length alternating with five lengths of simple creasing. The construction of fold line B results in a hinge which has the least resilience of the lot, while a fold line like line A which is simply creased but not cut at all results in a fold which has the maximum possible resilience and resistance to bending. Crease and through cut lines such as C and D provide an intermediate resistance and resilience.

The particular selection and arrangement of the various types of fold lines discussed above depends to a certain extent on the article being retained, its contours, and the nature of the material out of which the carton is made. Those of ordinary skill in the art will readily appreciate that ease of operation can result from the judicious selection and positioning of the various types of fold lines, but that the invention would be operable even if all of the fold lines A–D were simply scored like fold line A.

The hand movements necessary to spread or erect the panels 28, 30 and 32 of the flap 26 and to move the locking tab 38 into position are simple and natural. An operator can easily press on the crest at fold line B (FIG. 4), and using two hands can do this on two lock mechanisms 24 simultaneously. At the same time the operator can easily use an index finger to press the corresponding locking tab 38 into place. The ease with which these movements can be accomplished makes the carton 10 easy to load quickly and with a minimum of stress on the workers.

Figure 8:
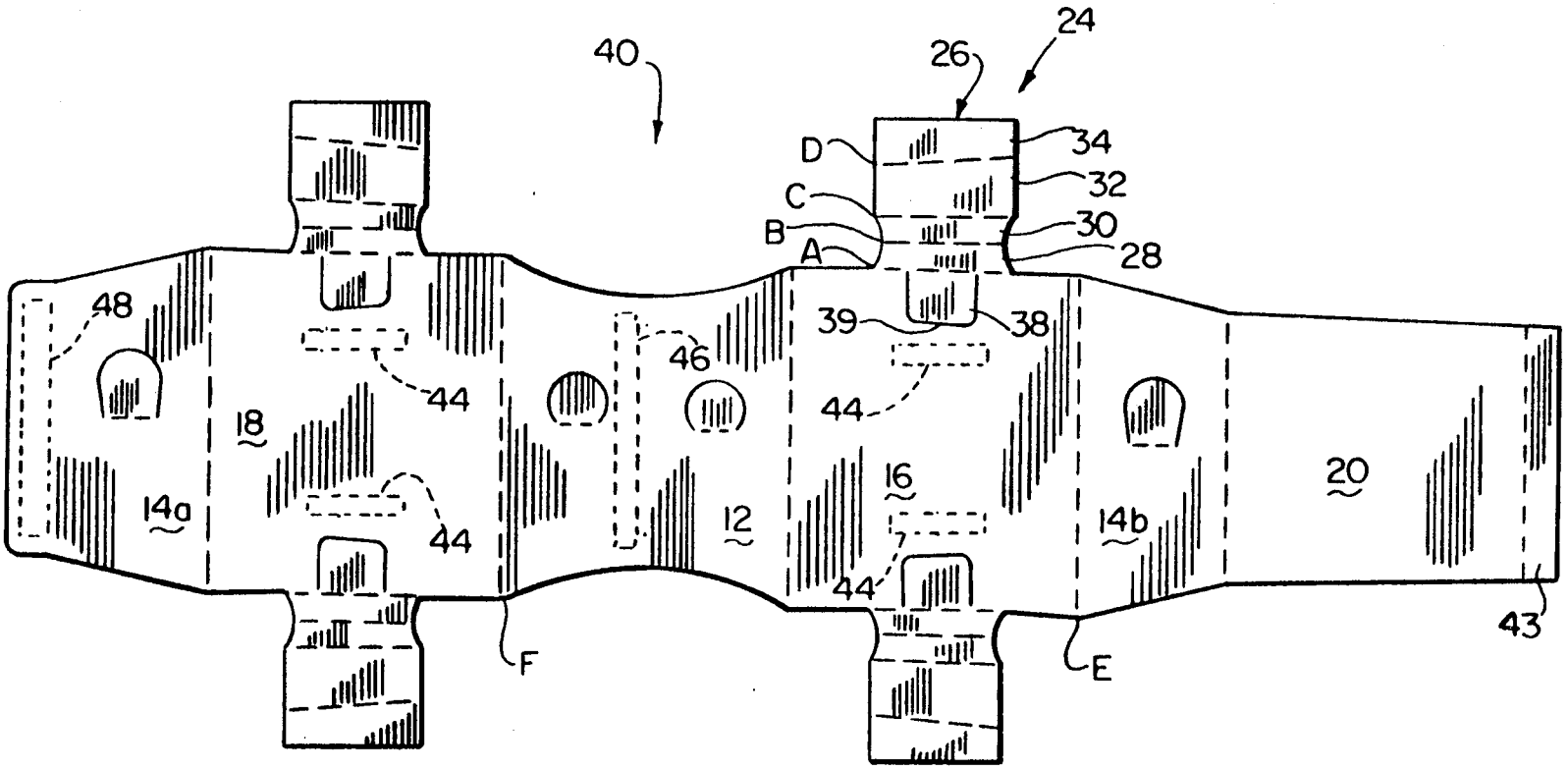
FIG. 8 is a plan view of a blank for making a carton constructed according to the present invention.

The carton 10 is made from the blank 40 illustrated in FIG. 8. The blank 40, other than the lock mechanisms 24, is conventional. The blank 40 includes a first half bottom panel 14A, side panel 18, top panel 12, right side panel 16, a second half bottom panel 14B, the central dividing panel 20, and a glue flap 43, moving from left to right in FIG. 8. Each of these panels is separated from its neighbor(s) by fold lines which are conventional creased fold lines.

To construct the carton 10, first the flaps 26 are folded and glued as discussed above. This is accomplished by applying glue to the inside surfaces of right and left side panels 16, 18, in the areas 44. Next the flaps are folded along fold lines B. The folding is done firmly so that the material takes a permanent set and remains in the FIG. 4 condition until intentionally shifted.

After the flaps 26 are folded and glued into the position shown in FIG. 4, glue is applied to the inside of the top panel 12 in the area shown at 46 and also to the first half bottom panel 14A at 48. Then the blank 40 is folded about fold line E. This brings the glue flap 43 into contact with the glue at 46 which will serve to hold the central dividing panel 20 to the inside of the top panel 12. Next, the blank is folded along fold line F to bring the glue at 48 into contact with the second bottom half 14B where it is glued in place.

The carton 10 is shipped in this flattened condition. To fill the carton, it is erected by shifting it along the fold lines until the top and bottom panels 12 and 14 are parallel and in vertical alignment with each other. Then the glassware can be put in and the lock mechanisms 24 folded into their article-retaining positions.

The sleeve defined by carton 10 may take various shapes depending upon the articles to be put in the carton. For example, with conventional cans, side panels 16 and 18 would be parallel to each other and perpendicular to the top and bottom panels 12 and 14. With glasses that are conical in shape, perhaps more conical than those shown in FIG. 1, the sidewalls could flare out or in, depending on the direction of taper of the glassware. Note in this regard that the fold lines A, B, C and D on the flap 26 are not parallel to each other, but slightly askew so that the face of panel 32, once the locking mechanism is engaged, is parallel to the surface of the tumbler and makes line contact with it, not just single point contact. In another contemplated variation, glasses may have bases that have a larger diameter than their tops. In such a case the sidewalls would taper to be wider at the bottom than at the top and the inclination of the fold lines A, B, C and D would be opposite to that shown. Yet another contemplated possiblity is that the carton will be used for glassware that is widest at its midsection such as some stemware. In such a case the sidewalls can be made to bow slightly, curving out from the bottom panel until the widest point of the glassware, and then curving back inward toward the top panel of the carton 10.

In all of these different carton shapes, the carton is profiled to fit the glassware snugly in a vertical direction and to hold the glassware on its sides. This enhances the grip on the glassware and holds it in the carton without excessive movement.

Thus it is clear that the present invention provides a carton 10 for glassware or the like with a unique and easy to use lock mechanism 24 which holds the contents securely in the carton while still allowing attractive display of the merchandise. The carton 10 is of the conventional sleeve type, having top and bottom panels 12 and 14, left and right side panels 16 and 18, and a central dividing panel 20 parallel to the sides. The ends of the carton are open. The carton accommodates four glasses, two on each side of the central panel 20. The carton 10 includes a lock mechanism 24 located on an edge of a respective side panel.

Each lock mechanism 24 is formed of two components. The first is a flap 26 which comprises three hinged panels connected to each other and the carton side panel along fold lines A, B, C and D. Initially the panels 28, 30 and 32 lie flat against the carton side panel 16 so that the carton can be loaded. Then the hinged panels are flexed along the fold lines to a second position in which they form a wedge shape as shown in FIGS. 1 and 7 on the inside of the side panel to keep the glassware inside the carton. The second component of each latch mechanism is a locking tab 38 which is pressed inward from the side panel to hold the hinged panels in their wedge position. The entire process of shifting the hinged panels to the wedge shape and latching them in that position can be easily accomplished using only a thumb and forefinger.

What is claimed is:

1. A carton for glassware or similar articles and formed of a flexible sheet material, said carton having top and bottom panels, a pair of side panels each connected to the top and bottom panels along fold lines to form a sleeve having two open ends having an interior for receiving the glassware or the like, and locking means on one of said side panels for holding the glassware or the like in the carton, said locking means including a flap forming a plurality of panels foldable from a first condition in which the panels of said flap extend from said one of said side panels so as to leave said ends open for loading of articles into the carton, to a second condition in which said panels form a wedge projecting inward from said one of said walls into the interior of the sleeve for retaining an article therein, and a locking tab for holding the panels of said flap in the second, wedge shaped condition.

2. The carton of claim 1 wherein the flap includes three panels hinged to each other in series, a proximal one of the panels of the flap being hinged to said one of the sidewalls and the distal one of said panels being hinged to an interior surface of the one of the sidewalls.

3. The carton of claim 2 further including a glue tab hinged to the distal one of the flap panels, the glue tab being glued to an interior surface of said one of said side panels.

4. The carton of claim 2 wherein the proximal one of the panels is hinged to said one of the sidewalls, and the proximal and an adjacent panel overlap each other when the locking means is in the first condition.

5. The carton of claim 4 wherein the length of the locking tab is at least as great as the sum of the lengths of the proximal and adjacent panels of the series of panels of the flap.

6. The carton of claim 5 wherein the proximal panel is hinged to the side panel of the carton along a first fold line and the locking tab is foldable about a fold line which parallels the first fold line.

7. The carton of claim 5 wherein proximal panel is hinged to the carton side panel along a first fold line and the fold line about which the locking tab folds is coincident with the first fold line.

8. The carton of claim 1 wherein the side panels of said carton are contoured to the article to be placed in the carton.

9. The carton of claim 8 wherein the sidewalls taper.

10. The carton of claim 9 wherein the sidewalls are closer together at the bottom of the carton than at the top of the carton.

* * * * *